United States Patent [19]

Hull

[11] Patent Number: 4,596,544

[45] Date of Patent: Jun. 24, 1986

[54] VACUUM BELT CARTON ERECTOR

[76] Inventor: Kent D. Hull, 2411 E. Sanson, Spokane, Wash. 99207

[21] Appl. No.: 645,230

[22] Filed: Aug. 29, 1984

[51] Int. Cl.[4] ..... B31B 1/80

[52] U.S. Cl. ..... 493/313; 493/312; 493/319

[58] Field of Search ..... 493/310, 312, 313, 314, 493/316, 317, 319, 409, 418, 423, 441, 450, 909, 315; 198/604, 689

[56] References Cited

U.S. PATENT DOCUMENTS

| | | | |
|---|---|---|---|
| 2,769,376 | 11/1956 | Chidsey, Jr. et al. | 493/319 |
| 3,040,866 | 6/1962 | Rehm | 198/689 |
| 3,056,338 | 10/1962 | Lovett et al. | 493/8 |
| 3,419,265 | 12/1968 | Greco et al. | 271/197 |
| 3,659,840 | 3/1972 | Ruck | 271/279 |
| 3,796,424 | 3/1974 | Fox | 271/197 |
| 4,331,436 | 5/1982 | Kutenbaum et al. | 493/310 |

FOREIGN PATENT DOCUMENTS

| | | |
|---|---|---|
| 1078499 | 3/1960 | Fed. Rep. of Germany . |
| 1292893 | 4/1962 | France . |

*Primary Examiner*—Francis S. Husar
*Assistant Examiner*—Robert Showalter
*Attorney, Agent, or Firm*—Keith S. Bergman

[57] ABSTRACT

A machine to erect flat-folded cartons, especially such as carry beverage containers, from a flat-folded storage configuration to three dimensional carrying configuration. The machine feeds folded containers from a storage hopper, in singulated fashion, between two endless forwardly flaring vacuum belts which hold the carton sides and move them simultaneously therealong to initialy expand the container. The partially expanded container is then completely expanded and fastened by a cooperating over-head positioning chain structure and an underlying cam wheel and thereafter delivered for further operation. The assembly operations are sequentially timed. The vacuum belts are particularly configured to allow a continuous, rapid operation with low air flow.

2 Claims, 12 Drawing Figures

VACUUM BELT CARTON ERECTOR

BACKGROUND OF INVENTION

Related Applications

There are no applications related hereto heretofore filed in this or any foreign country.

FIELD OF INVENTION

My invention relates generally to a machine for erection of flat-folded cartons to a three dimensional configuration and more particularly to such a machine that initially expands such cartons by means of paired, forwardly flaring vacuum belts.

DESCRIPTION OF PRIOR ART

Various types of small cartons, and especially those intended for holding similar small containers of various sorts, are commonly formed in a folded fashion for shipment and storage, to be thereafter expanded into a three dimensional configuration for use. This type of carton is especially used in the present day for cans or bottles of beverages and other fluids. The instant invention provides a machine to accept such flat-folded cartons and erect them to their expanded mode.

Various container assembling and erecting machines have heretofore become known and vacuum has been used as a means of releasably interconnecting various machine elements with cartons being operated upon. Heretofore, however, the means of applying vacuum to releasably hold a portion of a carton generally have comprised one or more resilliently deformable suction cups that have been carried by a machine element that moves with a discreet rather than a continuous motion. Most such devices have provided a vacuum pad on an arm-like element that may be moved over a particular course and thereafter recycled in a reciprocal fashion for the same sequential motion.

The instant invention is distinguished from this art in providing continuously moving, endless vacuum belts deiining plural holes arrayed in sets which are spatially arrayed in such fashion that at least a part of the sets of holes are sequentially supplied with vacuum as that belt portion defining them passes over an elongate plenum having a slot which communicates with a part of each hole to supply vacuum therethrough. The holes are particularly configured to allow the application of vacuum over a relatively large area to create appropriate forces needed to hold a carton but yet not allow the passage of excessive quantities of air, so that vacuum may be maintained in the system without excessive air flow or expenditure of energy. This is accomplished by providing vacuum orifices of a typical key-hole shape having an areally larger portion communicating with a container and a smaller portion communicating with the vacuum system.

My mechanism provides two such cooperating belts, in substantial rearward adjacency, that flare away from each other in a forward direction so that as a flattened container moves therealong, with sides maintained on each facing belt surface, it is partially expanded. This type of mechanism with continuous motion is advantageous over the traditional vacuum pads associated with mechanisms having discreet motion because it allows a more rapid and reliable operation that will erect boxes at at least twice the rate allowed by the discreet motion mechanisms heretofore used. In addition the belt allows a simpler and less expensive construction that may be more easily and accurately timed then those associated with the discreet motion devices. The partially expanded boxes exit from vacuum belt structure to be accepted between an overhead positioning chain and underlying cam mechanism that cooperatively move in timed fashion to complete the box formation and lock a tab structure on the bottom portion of the box to maintain erection. Both of these structures again operate in a continuous as opposed to a discreet fashion to speed the operation of carton assemblage and increase speed sufficiently to accept partially assembled cartons from the belt structure as delivered. Such operations in prior devices have generally been accomplished by carton holding vacuum pads that are moved in a particular mechanical course, generally in a discreet reciprocal fashion, to allow a capacity substantially less than the instant invention.

My mechanism is entirely self-contained, provides all necessary operative systems, and normally may be operated in a semi-automatic fashion that requires attendance by no more than one operator. Erected cartons are delivered for acceptance by ordinary conveying structures common to and heretofore used in the art.

My invention differs from the prior art not necessarily in any single structural feature or function but rather in the synergistic combination of all structures and functions herein set forth.

SUMMARY OF INVENTION

My invention generally provides an elongate frame with a rearward laterally extending hopper for folded boxes. Immediately forward of the hopper the frame carries two adjacent cooperating endless belts oriented with adjacent rearward courses that flare from each other in a forward direction. A delivery structure communicates between the hopper and rearward portion of the opposed vacuum belts to feed flat-folded cartons from the hopper between the belts in a timed, singulated fashion. Each belt defines spaced sets of plural holes communicating with a vacuum plenum immediately adjacent the back of each belt, along the portions of the two belts that are in adjacency. A bottom support structure immediately beneath the adjacent portions of the belts is provided to maintain the partially expanded boxes in appropriate vertical orientation between the belts and forwardly thereof.

Immediately forwardly of the belt structure is an overhead positioning chain and cooperating underlying cam to timedly accept the partially expanded boxes and complete their expansion and assemblage. A delivery structure in the forward part of the machine transiers the assembled boxes to a conveyer for iurther processing. The machine provides self-contained power and vacuum systems.

In creating such a machine it is:

A principal object of my invention to provide a carton erector that has two forwardly moving endless vacuum belts, oriented in a rearwardly adjacent and forwardly flaring attitude, to accept flat-folded cartons therebetween, hold each opposed carton side on the adjacent belt surfaces, and partially expand the cartons during their transit between the opposed belts.

A further object of my invention to provide such a machine that by reason of its continuously moving vacuum belt structure may erect flat-folded cartons to an expanded mode more rapidly than existing mechanisms having discrete reciprocal type operation.

A still further object of my invention to provide such a machine that has an overhead positioning chain mechanism and a cooperating underlying cam structure adapted to accept partially expanded cartons from the vacuum belts and cooperatively complete expansion to the erected mode.

A still further object of my invention to provide such a mechanism in which all operations may be readily timed for proper and rapid completion of the carton assembly process.

A still further object of m invention to provide such a machine that is of new and novel design, of rugged and durable nature, of simple and economic manufacture, and otherwise well adopted to the uses and purposes for which it is intended.

Other and further objects of my invention will appear from the following specifications and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and in which like numbers of reference refer to similar parts throughout.

DESCRIPTION OF PREFERRED EMBODIMENT

Figure 1:
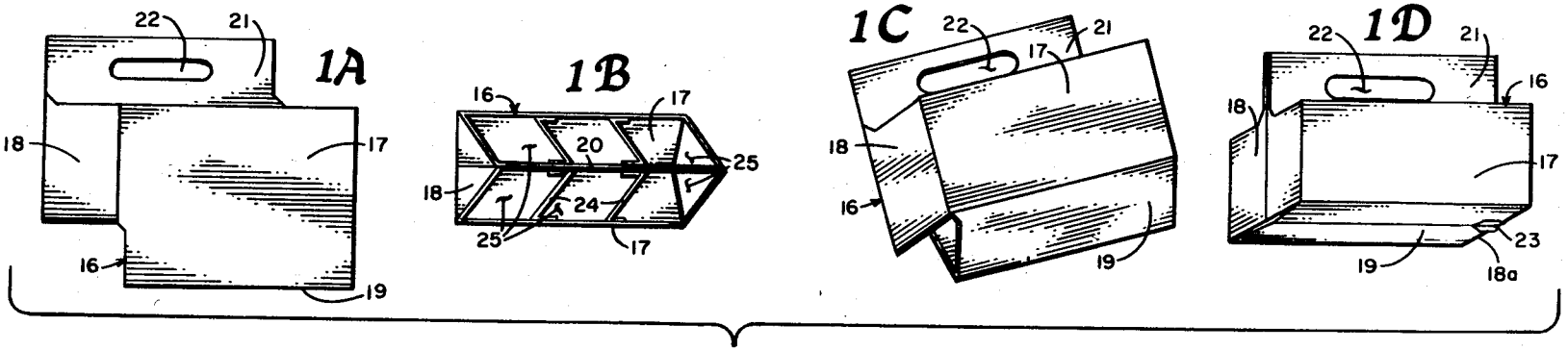
FIGS. 1A, 1B, 1C, 1D are semi-diagrammatic, serial illustrations showing the expansion, through four stages, of a carton from its flat folded mode to its erected mode, with each diagram of the Figures being sequentially lettered.

My invention generally provides peripheral frame 10 with storage hopper 11 for flat-folded cartons 16 which are expanded by continuously moving belt structure 12 and passed therefrom to positioning chain structure 13 which moves them over forming cam 14 where they are finally assembled and thereafter passed to delivery structure 15 for further processing.

My machine is particularly adapted for the erection of certain flat folded cartons adapted to carry beverage containers, though its essential principles may well be used in various machines dealing with other similar cartons and their assembly. The particular type of carton here concerned is that illustrated in various aspects and states of erection in the four diagrams that comprise FIGS. 1A, 1B, 1C, 1D of the drawings. The carton is formed with similar planar sides 17, similar ends 18 having vertical medial folds, and bottom 19 having an elongate medial fold as seen particularly in diagram 1C. The carton carries medial divider 20 extending above the sides and ends to form handle element 21 defining elongate hand hole 22 therein. This medial divider supports a plurality of internal septa 24 extending from it to each of the laterally outward adjacent sides, to define containment chambers 25 within which individual products or containers may be maintained. Carton end **18*a* defines notch-like fastening element 23** to releasably maintain the carton in the erected mode once this mode be attained.

These various parts are interconnected at adjacent edges, as illustrated in FIGS 1A, 1B, 1C, 1D, so that the carton may be folded into a flat or transport mode as shown in diagram 1A. To erect such a folded carton, sides 17 are firstly pulled away from each other as shown in diagrams 1B and 1C. To complete the assembly of the carton, its various parts are moved into a rectilinear relationship, as shown in diagram 1D, with the bottom element carried within the notch defined between end **18*a* and fastening element 23. The ears of the fastening element are then folded on the underside of bottom 19** and may be there mechanically maintained, if so desired, such as by adhesion. This type of carton is well known in the packaging arts for containment of a plurality of small containers such as for beer, soda pop and the like. This is the type of container my invention is particularly adapted to erect.

My invention provides a peripheral post and beam frame with similar side elements formed by paired opposed cooperating forward posts 26, medial posts 27 and shorter rearward posts 28, providing vertical support for lower horizontal beams 29, medial horizontal beams 30, and upper horizontal beams 31. Various cross beams 32 maintain the side elements in spaced parallel adjacency and various sub-frame elements 33 positionally maintain machine components as required.

Preferably these frame elements are formed of metallic channel-type beams, as illustrated, to provide appropriate strength and rigidity but yet maintain weight and cost within viable economic ranges. These beams preferably are formed of rolled steel and if this be the case, the preferred method of interconnecting adjacent surfaces of adjoining frame elements is by welding. Shielding of the various moving components may be readily accomplished by the attachment of panels (not shown) to the peripheral surface of the frame as required, especially as required to comply with safety codes. This shielding is well known in the packaging machine arts and the shielding panels are therefore not shown so that my machine may be more clearly and simply illustrated.

Figure 2:
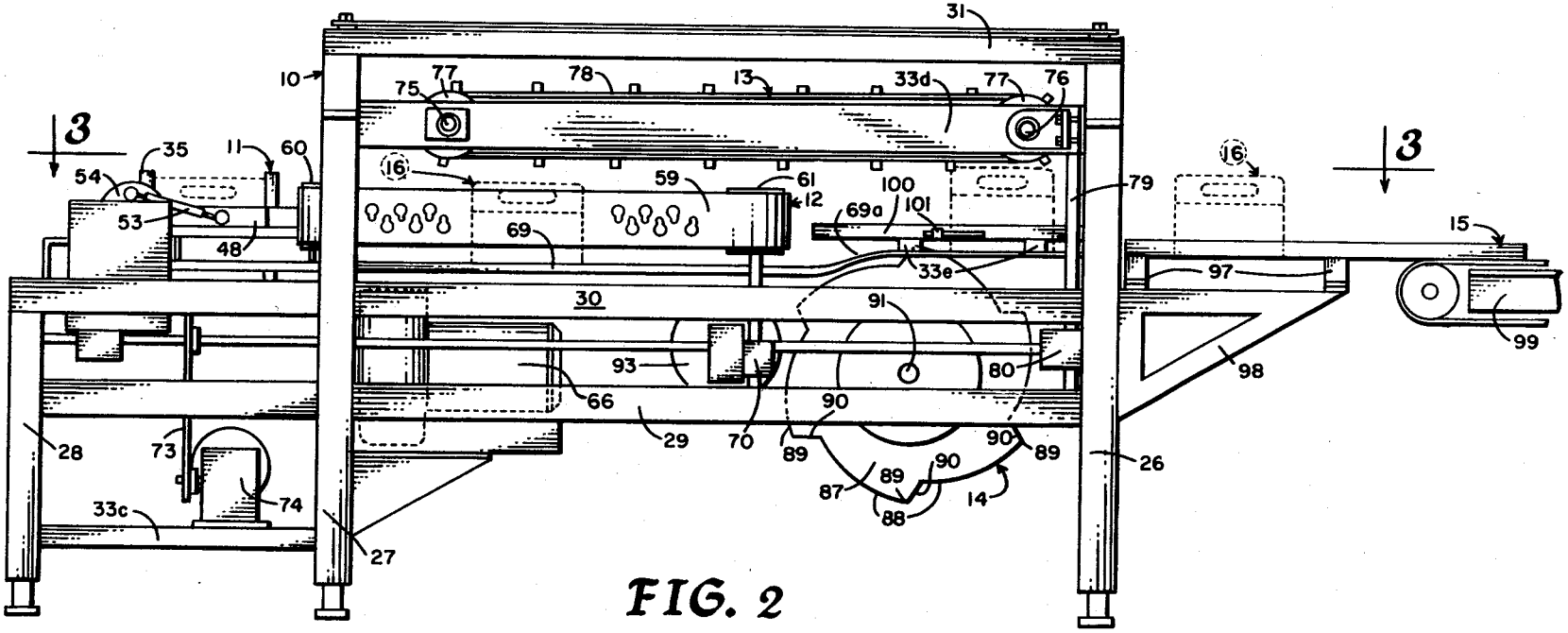
FIG. 2 is an orthographic side view of my machine with several cartons in dashed outline in different positions therein, showing its parts, their configuration and relationship.
Figures 3, 4, 5, 6, 7, 8, 9:
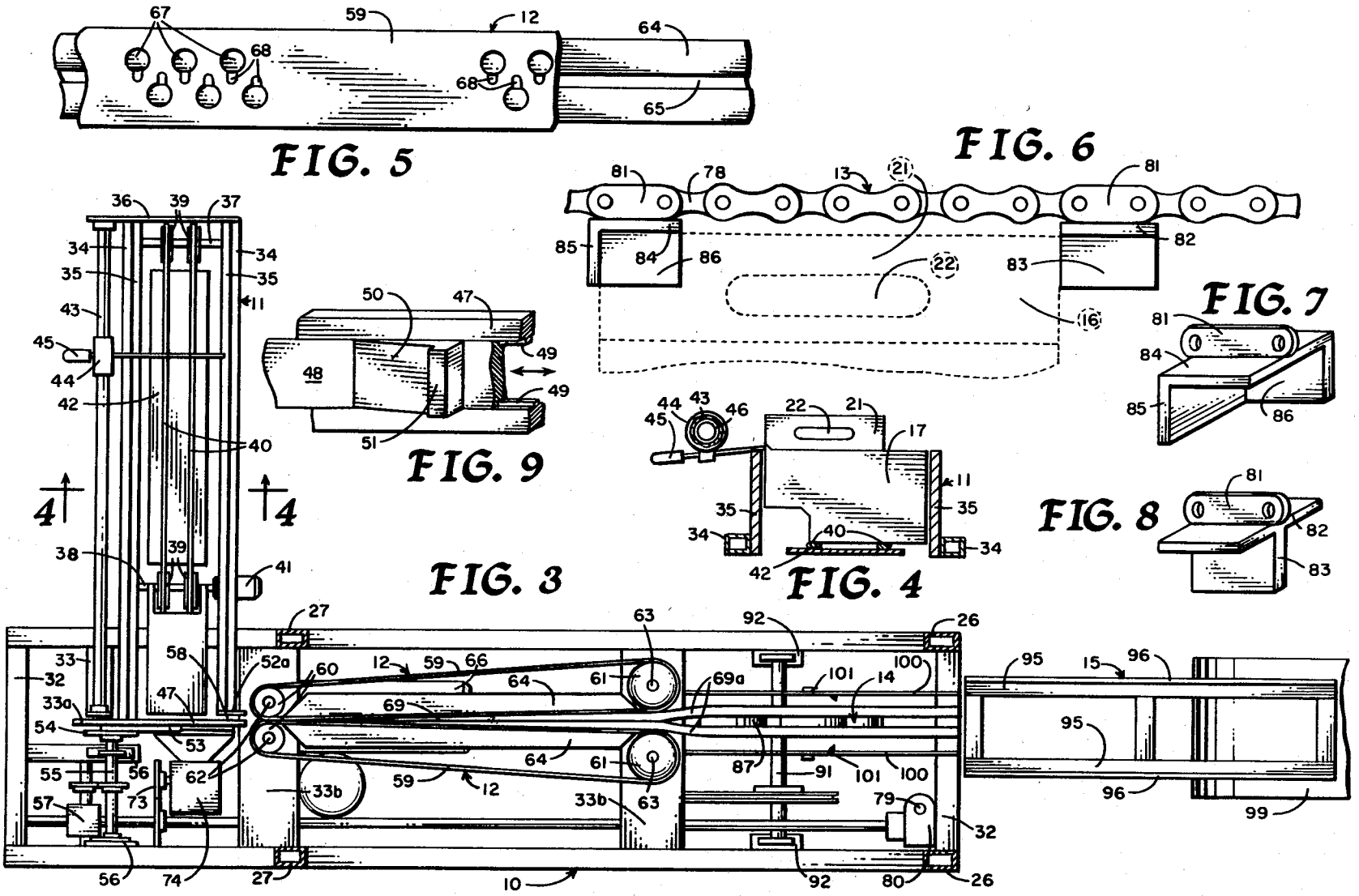
FIG. 3 is a horizontal sectional view of the machine of FIG. 2, taken on a line 3—3 in the direction indicated by the arrows thereon.
FIG. 4 is a vertical cross sectional view through the hopper structure of my machine, taken on the line 4—4 of FIG. 3 in the direction indicated by the arrow thereon.
FIG. 5 is a somewhat enlarged, partial cut-away view of a section of a vacuum belt of my machine and of the vacuum plenum rearwardly adjacent thereto, showing the configuration and relationship of the holes defined in the belt and the orifice of the vacuum plenum.
FIG. 6 is a somewhat enlarged, partial view of a section of the overhead positioning chain showing its elements, their configuration and relationship.
FIG. 7 is an enlarged isometric view of a rearward element of a set of carton positioning elements carried by the positioning chain illustrated in FIG. 6.
FIG. 8 is an enlarged isometric view of a forward element of a set of carton positioning elements illustrated in FIG. 6.
FIG. 9 is an enlarged isometric view, looking inwardly from the hopper, of the mechanism that feeds flat-folded cartons to the vacuum belt structure.

To make the description of my mechanism simpler the portion to the right of the illustration of FIG. 2 is referred to as forward and that to the left of that Figure is referred to as rearward because cartons move in the direction indicated. Lateral-wise the side of my mechanism that is lowermost in FIG. 3 is referred to as right and that that is uppermost in FIG. 3 is referred to as left, as if an observer would be standing rearwardly of the invention of FIG. 3 and looking forwardly toward the mechanism.

Horizontally oriented storage hopper 11 extends laterally outwardly from the left side of the frame. This hopper provides similar opposed, parallel bottom rails 34 each supporting vertically upstanding sides 35 at their outer edges. The rails are supported on the upper surface of medial horizontal beam 30 of the frame and may be cantilevered or supported at their outer portions upon an underlying supporting surface by vertical legs (not shown). The bottom rails are interconnected at their left lateralmost extension by upstanding hopper end 36.

Outer feeder belt shaft 37 is journaled between rail 34 inwardly adjacent their lateralmost extension and inner feeder belt shaft 38 is similarly journaled immediately laterally of the communication of the hopper structure with frame 10. Each of these shafts in their medial parts carry two spaced feeder belt pulleys 39 which cooperate to carry two endless feeder belts 40 in vertical position such that their upper surfaces come into irictional contact with the lower portion of folded containers in the hopper to bias the cartons to an inward position in the hopper. The belts are moved, with their upper portion moving toward the frame, by motor 41 supported by the hopper rail structure. The medial portions of the belts are maintained in appropriate horizontal position by feeder belt plate 42 positioned immediately below the normal course of the undersurface of the belts to prevent excessive medial sag therein.

Further mechanism to bIas cartons to move inwardly through the hopper is provided by elongated biasing rod 43 carried at its outer end by the extension of hopper end 36 and at its inner end by sub-irame support 33*a*. The biasing rod, as shown especially in the cross sectional view of FIG. 4, provides collar 44 slideably and pivotally engaged thereabout with biasing arm 45 extending inwardly into the hopper structure therefrom. Compression spring 46 carried within the hollow biasing rod 43 and communicating through a slot therein biases collar 44 to an inward position to ultimately cause cartons in the hopper to be biased inwardly toward the frame of my mechanism. This biasing device may be selectively actuated by rotating the collar on the rod to move the biasing arm into or out of communication with cartons carried in the hopper.

The inner end of the hopper provides vertically upstanding inner bulkhead 47 that stops the inward motion of cartons in the hopper. This bulk head is a compound structure with a vertically medial sliding portion 48 maintained therein by mortise and tenon joints 49 for motion in a forward and rearward direction. The side of slide 48 that faces the hopper carries carton catch structure with ramp 50 extending to carton catch 51 configured to engage the rearward end of a single carton and move it forwardly from the hopper along the bulkhead and through carton orifice 58 defined between the bulkhead and orifice wall 52 at a spaced distance therefrom.

Medial carton slide 48 is moved in a timed reciprocating motion in bulk head structure 47 by eccentric arm 53 having one end pivotally carried by the slide and the other end extending into pivotal connection with the peripheral portion of slide drive wheel 54. This drive wheel in turn is irrotatably carried by bulkhead drive shaft 55 supported in bearings 56 on the machine frame and powered by bulkhead drive motor 57 positionally maintained in mechanical linkage adjacent thereto. With this linkage the bulkhead drive motor will move carton slide 48 in a reciprocal forward-rearward motion to feed individual cartons carried in the hopper in a forward direction through the hopper orifice.

Vacuum belt structure 12 is located in the same medial horizontal plane as the hopper, immediately forwardly of hopper orifice 58, to receive cartons therefrom and begin their expansion. The vacuum belt structure provides similar endless expansion belts 59 each carried on smaller rearward belt cylinders 60 and larger forward belt cylinders 61. The rearward belt cylinders are irrotatably carried on rotatably journaled rearward belt shafts 62 and the forward belt cylinders are similarly carried on forward belt shafts 63 journaled in appropriate bearings supported by sub-frame cross-elements 33*b*. The rearward belt shafts are so positioned that the adjacent surfaces of the two belts are in close proximity with only enough space therebetween to allow the passage of a folded carton. Forward belt shafts 63 are spaced further apart so that even with the larger forward belt cylinders there still is some substantial space between the forward portions of the adjacent surfaces of the two belts, all as illustrated particularly in FIG. 3.

Similar elongate vacuum plena 64 are provided immediately inwardly adjacent the laterally outer surface of the inner course of each of expansion belts 59. These plena are supported on sub-frame cross elements 33*b*. The inner surface of each plenum, adjacent either belt, defines elongate, relatively narrow vacuum channel 65, as illustrated especially in the enlarged view of FIG. 5. Vacuum is supplied to each plenum by vacuum system 66 supported by frame 10 in its lower rearward part.

The detailed structure of expansion belts 59 is shown in FIG. 5 where it is seen that they define spaced groups of keyhole-like orifices, each having larger circular portion 67 at a spaced distance from a medial line and communicating smaller key-way portion 68 extending therefrom to and across the medial line. These orifices are positionally defined in the belts, relative to its course over the vacuum plena, so that smaller keyhole portions 68 communicate with the plena vacuum channels while the larger circular portions 67 do not. A plurality of these orifices 68, 69 are defined in similar spatially arrayed groups, each group having substantially the same length as the sides of a carton to be erected, so that cartons placed adjacent the belt surface may be held thereon by reason of the vacuum existing in the orifices. The course the belt travels along the face of each vacuum plenum 64 is such as to cause a substantially airtight seal, or at least one that prevents the leakage of any substantial volume of air therethrough, so that a substantial portion of the vacuum presented in the plena exists in orifices 67, 68.

Elongate carton bottom support 69 extends in a forward-rearward direction from the hopper orifice forwardly along the medial line between the forwardly diverging courses of the expansion belt structure. The bottom support splits in the form of a "Y" at approximately the position of the forwardmost course of the expansion belts. The rearward portion of this element is at the horizontal level of the bottom portion of a carton as it leaves the hopper structure. The bottom support maintains this level until it passes immediately forwardly of the forwardmost part of the expansion belt structure, where it raises slightly so that the forwardmost split portion 69*a* is somewhat vertically higher than the rearward part.

Forward belt shaft 63 is powered through right angle drive 70 by main drive shaft 71 supported by appropriate bearings 72 on frame 10. This main drive shaft in turn is powered by belt-pulley linkage 73 communicating with main drive motor 74 carried by sub-frame element 33*c* as shown especially in FIG. 2.

Positioning chain structure 13 extends in a longitudinal direction between forward vertical posts 26 and medial vertical posts 27 and above a carton during its course of travel through the vacuum belt structure. Elongate sub-frame beams 33*d* are carried between the vertical post on each side of my frame to form a framework between which the positioning chain structure is supported. Rearward positioning chain axle 75 is journaled in the rearward portion of these sub-frame beams and forward positioning chain axle 76 in their forward part immediately rearwardly of the forward vertical frame posts. Each of these axles, in a medial position, supports sprocket wheels 77 which carry link-type positioning chain 78 therebetween, all as shown in gross in FIG. 2. Forward axle 76 is rotatably driven by mechanical interconnection (no shown) with auxiliary drive shaft 79 which in turn is driven through transmission box 80 by primary drive shaft 71.

As seen in the enlarged partial view of FIG. 6 and the isometric views of FIGS. 7 and 8, link chain 78 provides spaced pairs of special links 81 carrying cooperating pairs of carton contact elements. The forward carton contact element provides upper plate 82 structurally supporting depending vertical stop 83. The rearward carton contact element provides upper plate 84 supported on link 81 and in turn structurally supporting perpendicularly depending back element 85 and side element 86.

The carton contact elements are so configured and positioned as to maintain handle 21 of a carton therebetween, as illustrated in FIG. 6, to position that carton and cause it to move forward responsively to chain motion. The horizontal positioning of the positioning chain structure is such that it is a spaced distance above the upper handle portion of cartons during their course through the vacuum belt structure, but is in contact with them when they are supported by raised forward portion 69*a* of carton bottom support 69, as illustrated in FIG. 2.

Forming cam 14 is illustrated in FIG. 2 where it is seen to comprise a six lobed, relatively thin disk 87. Each lobe of the cam defines a relatively long arcuate ramp 88 terminating in peak 89 with relatively sharp drop off 90 communicating to the next lobe. The cam is so configured and dimensioned as to fit within the space defined between split portions of forward part 69*a* of the carton body support and it is sized and positioned, as illustrated, so that peaks 89 of the cam will extend very slightly above the upper surface of forward portion 69*a* of the carton bottom support.

The forming cam is irrotatably mounted on cam shaft 91 which in turn is journaled in bearings 92 supported on side beams 29 of frame 10. The cam shaft is driven by cam shaft motor 93, supported on frame 10, by pulley-belt linkage 94 communicating therebetween.

Slightly forwardly of the forming cam structure and above forward portion 69*a* of carton bottom support are provided cooperating, elongate spaced carton side supports 100 supported on the principal frame by sub-frame elements 33*e*. The supports are spaced so that the distance between their adjacent surfaces is substantially equal to the distance between sides of a formed carton. Preferably these supports in their medial portion carry inwardly projecting holding dogs 101 having forwardly and inwardly angled ramps to provide some appropriate force upon a formed carton passing therebetween to insure the complete formation of that carton. Preferably the holding dogs are carried in slots defined in sub-frame elements 33*e* so that they may be adjustably positioned in a forward-rearward direction for most effective use. They may be releasably maintained by friction or mechanical fasteners (not shown).

Delivery structure 15 provides delivery ramp 95, with upstanding side rails 96, supported on legs 97 for appropriate height by delivery ramp bracket 98 extending forwardly of the forward upright post 26 of the frame. This delivery ramp structure provides ramp 95 at appropriate vertical elevation to receive formed cartons from my machine and pass them to secondary delivery structure such as conveyer 99 for further processing or filling.

Having thusly described the structure of my machine, its operation may be understood.

Firstly a is formed according to the foregoing specification and its hopper is loaded with a plurality of flat-folded cartons of the type described and in the orientation shown. In this condition various operative mechanisms are activated so that the machine may begin its function.

The innermost carton in the hopper is contacted at its rearward edge by carton catch 51 of medial slide portion 48 of inner hopper bulkhead 47. The carton is moved forwardly along the inner hopper bulkhead responsive to the slide motion and passes through hopper orifice 58. As the forward portion of the carton moves forwardly of the hopper orifice, it moves into a position between the inner course of expansion belts 59 where it is frictionally engaged thereby and caused by the motion of those belts to move forwardly therebetween.

The timing of the delivery of a carton between the expansion belts is such that the side surface portions of a carton will be adjacent one of the plural spaced groups of holes defined in each of those belts. Vacuum will be applied through the group of holes on the each side of the carton, and aided by ambient air pressure, will firmly attach those sides to the inner surfaces of the expansion belts. As the carton moves forwardly between the expansion belts each side will remain firmly attached to the surface of the adjacent expansion belt, and since the course of each of those belts diverges in a forward direction, each of the sides of the carton will be moved away from the other so that the expansion of the flat-folded carton begins. The vertical elevation of the carton will be determined by reason of its support on carton bottom support 69. At the inception of the expanding operation of a flat-folded carton, it is necessary that the operation begin with some substantial force as often irregularities in the carton manufacturing process adhere various carton parts that are not intended to be adhered or will otherwise form them in a fashion to resist expansion. In my invention, however, if the vacuum plena have a pressure of some few pounds below that of the ambient atmosphere, the forces generated are quite adequate to give extremely high reliability for my expansion process. With normal configuration of components in the range illustrated, a vacuum of from five to ten pounds below the normal air pressure is quite sufficient and readily maintainable.

As the partially expanded boxes move forwardly to exit from vacuum belt structure 12, their forward portion firstly, and progressively the entire carton, moves vertically upwardly by reason of support on the carton bottom support 69, since its forward portion 69*a* is higher than its rearward portion. As this motion of the carton is accomplished and as the forward portion of the carton enters the raised part 69*a* of the bottom support, the forward part of the carton handle structure comes into engagement with a front carton contact element 82, 83 of the positioning chain structure. Very shortly thereafter the rearward portion of the carton handle structure is contacted by the forward portion of a rearward carton contact element of the positioning chain so that the handle structure is uniquely positioned between the two cooperating carton contact elements. The timing of motion of the positioning chain structure is such, in relation to that of the vacuum belt structure, as to accomplish this positioning. This timing is accomplished, most immediately, in the instance illustrated by mechanical means, but it may well be accomplished electronically, hydraulically or by other means known in the packaging arts.

Immediately after a carton is engaged by the positioning chain structure, it is moved thereby into contact with peak 89 of one lobe of disk cam 87, and is moved thereagainst with some force, to cause the front end of the carton to be completely formed and brought into adjacency with the forward portion of the carton bottom and into a substantially perpendicular relationship with the sides. As this is accomplished the forward portion of the bottom is moved into the notch defined in the forward portion of fastening ears 23 to completely assemble the box This action is aided by the passage of the box between dogs 101 of carton side support 100 substantially simultaneously with its stoppage by cam element 14. This action occurs instantaneously and immediately thereafter the cam turns to allow passage of the assembled carton thereover. The carton then moves forwardly along bottom support 69 to exit onto delivery ramp 95 in an assembled mode. It is then passed therefrom for further processing.

The timing of disk cam 14 is again, in the instance illustrated, regulated by known mechanical means.

It should be particularly noted from the foregoing description of my invention that it might quite rapidly erect cartons by reason of its continuous motion as distinguished from the discrete type motion of carton erecting machines of the prior art. Though vacuum-type holding has been known in the packaging arts for the assemblage of cartons, the known methods have provided vacuum cups carried by some reciprocally movable element to contact and hold a portion of a box during the erection process as distinguished from my vacuum belt structure where the vacuum applying element itself continuously moves and is not directly associated with a reciprocally movable element.

It is further to be noted that the keyhole type configuration of vacuum orifices defined in the expansion belts provides a relatively small orifice to pass over the orifice of a vacuum plena to prevent any excessive air flow through the vacuum system and thus allow its maintenance with a minimum of mechanism and power. With this type of keyhole orifice, substantially all of the vacuum available in the plenum is applied over the entire surface of an orifice, according to well known physical principles, but yet the air flow is relatively limited as only a small portion of the area of the entire orifice is in contact with the orifice of a plenum to substantially limit air flow in the vacuum system.

It is further to be noted that my apparatus may erect cartons at a rate of about 150 per minute which is two to three times faster than known mechanical devices having a discreet type operation with reciprocally moving mechanical elements.

The foregoing description of my invention is necessarily of a detailed nature so that a specific embodiment of it may be set forth as required. it is to be understood, however, that various modifications of detail, rearrangement and multiplication of parts may be resorted to without departing from its spirit, essence or scope.

Having thusly described my invention, what I desire to protect by Letters Patent, and what I claim is:

1. A machine for the expansion and erection of flat-folded cartons of the type having similar sides movable away from each other for erection, comprising, in combination:

an elongate frame supporting at a first rearward end a laterally extending hopper having means to move cartons inward against an inner bulkhead;

slide means carried by the inner bulkhead to move singulated cartons forwardly thereof;

opposed, cooperating, vertically oriented expansion belts, extending forwardly from the slide means, to accept cartons from the slide means between the expansion belts, each expansion belt having vacuum means to releasably fasten the opposed sides of a carton against the adjacent faces thereof, said belts diverging in their adjacent forward courses a distance not more than the distance between the sides of an erected carton, and said vaccum means including a plurality of orifices defined in spaced set of spaced groups in each expansion belt, each orifice having an areally larger portion at a spaced distance from a line and a smaller slot-like portion extending to and past that line and having a vacuum plenum, communicating with the rearward side of each belt, with an elongate orifice positioned along the line immediately aforesaid;

positioning chain means, carried by the frame immediately forewardly of the expansion belts, for accepting partially expanded cartons from the expansion belts and moving them forward thereof; and disk cam means, carried by the frame immediately forewardly of the positioning chain means, for completing the formation of a carton to its erected mode.

2. In a machine for the erection of flat folded cartons of the type assembliable by moving one side away from the second side, the invention comprising, in combination:

a rigid elongated frame supporting at a first rearward end;

a storage hopper, for vertically oriented, flat-folded cartons, extending laterally from the rearward part of said frame and having means of biasing cartons therein to an inward position, said hopper having an inner bulkhead to stop the inward motion of cartons therein, said bulkhead having slide means to move the inwardmost carton forwardly thereof;

an expansion belt structure carried by the frame, immediately forwardly of the slide means of the hopper bulkhead, adapted to receive singulated flat folded cartons therefrom, said expansion belt structure having opposed endless belts carried by the frame for motion in adjacent courses positioned to accept singulated cartons from the slide means of the hopper bulkhead and move the cartons in sequential fashion forwardly therebetween, said belts being positioned so that their adjacent courses expand away from each other in a forward direction a distance not more than the distance between the sides of an erected carton, each said belt having spaced groups of spaced vacuum orifices defined therein and a vacuum plenum immediately rearward of the adjacent courses of each belt, and each said vacuum plenum defining an elongated slot-like orifice communicating with only a portion of each of the orifices defined in the expansion belts;

an elongate bottom support, below the adjacent courses of the belt structure, to support a carton passing between the expansion belts from downward displacement, said bottom support extending forwardly of the vacuum belt structure in a split and upwardly orientated course to move a carton supported thereby upwardly a spaced distance after its exits from the expansion belt structure;

positioning chain structure, at a spaced distance above the raised forward portion of the carton bottom support, having a positioning chain moving parallel to the carton bottom support at a spaced distance thereabove to communicate with the top portion of a carton support by the said raised forward portion of the carton bottom support to move such carton therealong;

a disk-like cam, rotating about a horizontal axis, carried between the split forward portions of the carton bottom support to contact the bottoms of cartons moved by the positioning chain to complete erection thereof; and means located at said rearward end for powering the machine elements, for supplying vacuum to the vacuum plena and for removing erected cartons from the machine.

* * * * *